United States Patent [19]

Toffolon et al.

[11] 4,351,507

[45] Sep. 28, 1982

[54] MULTI-PART FORM WITH IMPROVED TIE AND STRIPPING MEANS

[75] Inventors: Roger L. Toffolon, Hartford; Warren E. Kart, Bristol, both of Conn.

[73] Assignee: Doublewal Corporation, Plainville, Conn.

[21] Appl. No.: 225,692

[22] Filed: Jan. 16, 1981

[51] Int. Cl.[3] ..... B28B 1/08; B28B 7/10; B28B 7/04

[52] U.S. Cl. ..... 249/63; 249/66 R; 249/124; 249/135; 249/160; 249/163; 249/170; 425/186; 425/424; 425/432; 425/441; 425/456

[58] Field of Search ..... 249/120, 63, 121, 122, 249/124, 135, 137, 142, 160, 161, 162, 170, 163, 168, 169, 66 R; 425/424, 432, 436 R, 441, 554, 182, 186, 456

[56] References Cited

U.S. PATENT DOCUMENTS

| | | | |
|---|---|---|---|
| 784,701 | 3/1905 | Petrie | 249/63 |
| 798,947 | 9/1905 | Burkholder | 249/63 |
| 804,423 | 11/1905 | Miller | 249/162 |
| 974,350 | 11/1910 | Bratton | 249/161 |
| 2,512,092 | 6/1950 | Dike et al. | 425/424 |
| 2,532,049 | 11/1950 | Wittke | 249/162 |

*Primary Examiner*—Willard E. Hoag
*Attorney, Agent, or Firm*—McCormick, Paulding & Huber

[57] ABSTRACT

A multi-part form for casting concrete structural units having spaced parallel and vertical sidewalls and horizontally spaced parallel and lateral connecting arms therebetween, the connecting arms having mortises at the bottom and tendons at the top. A stationary base and support means has upwardly exposed surfaces for forming the bottoms of the sidewalls and the arms and a core means thereon forms inner vertical surfaces of the arms and portions of inner vertical surfaces of the sidewalls of the structural unit. Opposing movable sidewall form members form outer surfaces of the sidewalls and opposed movable arm and sidewall form members form outer surfaces of the arms and inner surfaces of the sidewalls outwardly of the arms. Sidewall end surface form members on the sidewall form members form the end surfaces of the arms. Tie and strip bolts respectively secure the movable form members in inner assembled positions and urge the members outwardly in a stripping operation after casting. The movable members slide on rails on the base and support means when urged outwardly.

11 Claims, 4 Drawing Figures

FIG. 1
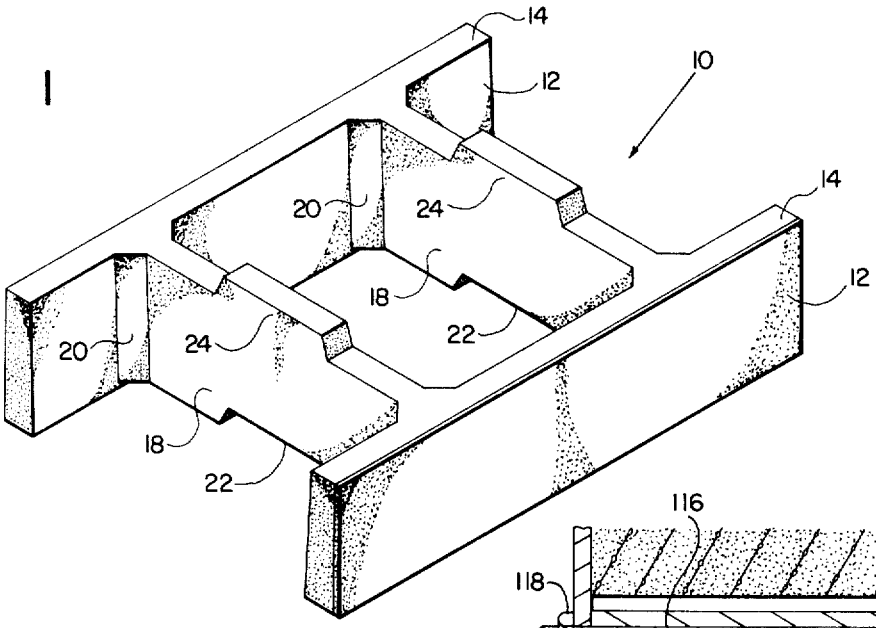
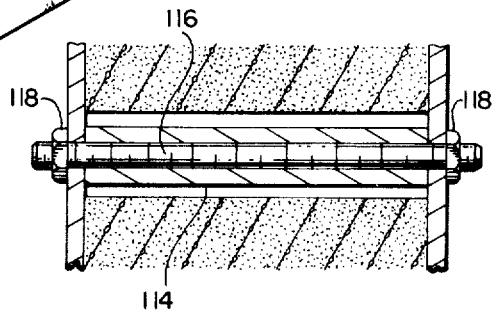
FIG. 4
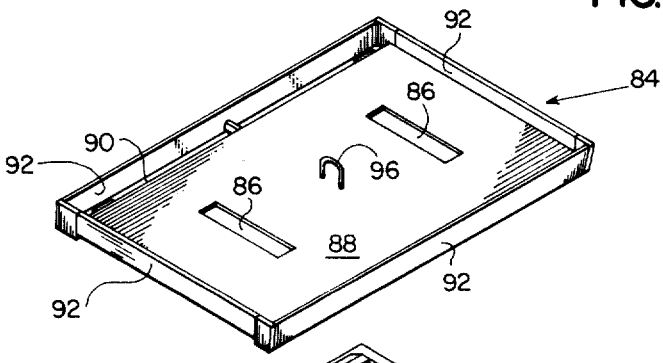
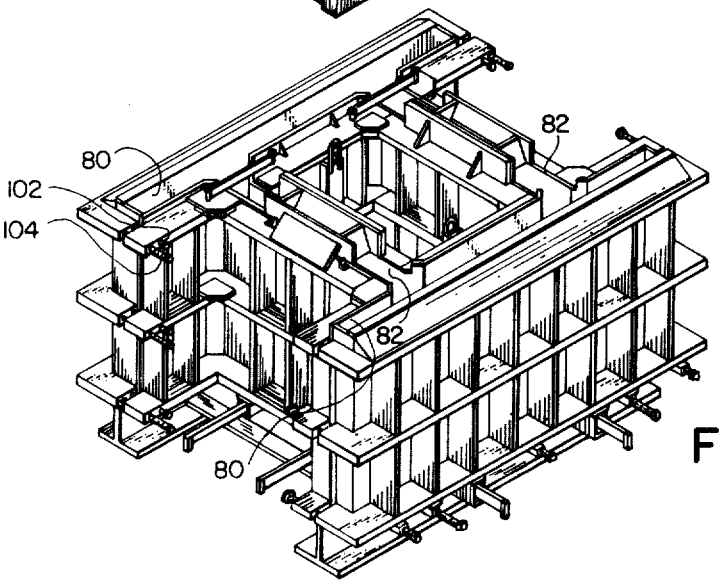
FIG. 2

MULTI-PART FORM WITH IMPROVED TIE AND STRIPPING MEANS

BACKGROUND OF THE INVENTION

A wide variety of forms for casting concrete have been employed in the past. When the forms are used in a casting plant and the cast product thereafter shipped to site, and when a relatively large number of like cast products are to be provided, it is of course desirable to provide for a high production rate. One of the principle time factors involved is in the stripping of forms, the removal of a cast product, and the subsequent tieing of the forms in assembled positions for the subsequent casting of a second similar product. Various means have been provided for tieing and stripping movable form members but have not been wholly satisfactory, particularly with regard to the ease and convenience of use and speed of operation.

It is the general object of the present invention to provide a multi-part form for casting a specific structural unit having a pair of spaced sidewalls and interconnecting arms, the form being adapted for efficient casting and a high degree of ease and convenience in tieing and stripping movable form parts or members.

SUMMARY OF THE INVENTION

In fulfillment of the foregoing object, a multi-part form for casting concrete structural units for retaining walls and the like is provided. The structural units have generally rectangular horizontally spaced parallel and vertical sidewalls which extend longitudinally and which have horizontally spaced parallel and laterally extending substantially vertical connecting arms integrally formed therebetween. The connecting arms each have a downwardly open mortise at the bottom and an upwardly projecting tendon at the top.

The multi-part form comprises a stationary base and support means which includes horizontal upwardly exposed surfaces for forming the bottom surface of each sidewall and arm of a structural unit. A stationary core means is mounted on the base and support means and takes a generally rectangular configuration viewed from above. Thus, the core has substantially vertical outwardly exposed surfaces for forming the inner surfaces of the arms of a structural unit and the inner surfaces of sidewalls of the unit between the arms. A pair of movable similar but opposite sidewall forming members have substantially vertical surfaces for forming the substantially vertical outer surfaces of the opposite sidewalls of a structural unit. A pair of movable similar but opposite arm and sidewall form members have substantially vertical surfaces for forming the substantially vertical outer surfaces of the arms and inner surfaces of the sidewalls outwardly of the arms respectively at opposite ends of the structural unit. Sidewall end surface form members have substantially vertical surfaces for forming the substantially vertical surfaces at the ends of the sidewalls of a structural unit and are preferably attached to and form a part of the opposite sidewall form members.

Form tie and strip means are adapted for high speed operation and ease and convenience in tieing and stripping and comprise tie bolts and strip bolts which may be driven by power tools in a stripping or tieing operation. A plurality of tie bolts are operatively associated with each of the movable form members and the stationary base and support means and a plurality of strip bolts are operatively associated with the base and support means and each of the movable form members. Slide and guide way means operatively associated with stationary base and support means and each of the movable frame members may take the form of slide rails on the base and support means and guideway means on the movable form members, the movable members being slidable outwardly during a stripping operation.

Mortise forming surfaces are provided on the base and support means for the mortises at the bottom of the arms in the structural units and the core means and movable arm and sidewall form members include movable, preferably swingable, tendon forming means which may be swung to an operative position for tendon forming and to an inoperative position for clearance of the arm cavity during a stripping operation. Further, vibratory means are preferably provided within the core means and may be operated after the concrete has been poured and the product cast within the form. Operation of the vibratory means serves to break the bond of the cast concrete to the core means and facilitates the upward withdrawal of the cast product from its position about the core after the movable form members have been withdrawn or moved outwardly.

BRIEF DESCRIPTION OF THE DRAWINGS

FIG. 1 is a perspective view of a cast concrete structural unit for retaining walls or the like, the forms of the present invention being adapted for casting the said unit.

FIG. 2 is a perspective view of a multi-part form constructed in accordance with the present invention and in an assembled condition ready for casting of a structural unit therewithin.

FIG. 4 is a fragmentary enlarged view showing a device which may be employed in lifting a cast product from its position about a core means after stripping of the forms.

DESCRIPTION OF PREFERRED EMBODIMENT

Figure 3:
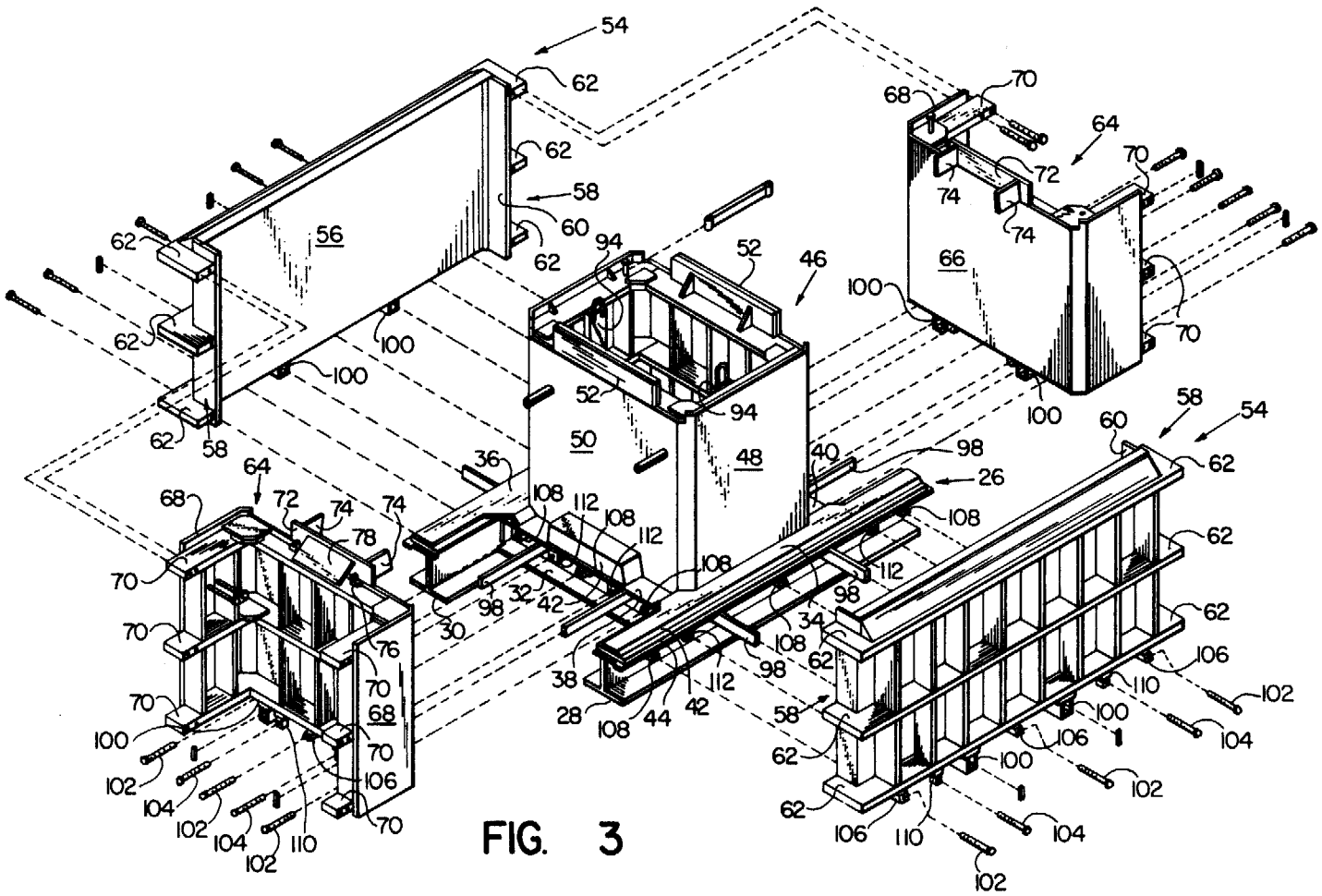
FIG. 3 is a perspective exploded view of the multi-part form of FIG. 2.

Referring particularly to FIG. 1, it will be noted that a precast concrete structural unit indicated generally at 10 has generally rectangular horizontally spaced parallel and vertical sidewalls 12, 12. The sidewalls extend longitudinally and have horizontally spaced parallel and laterally extending substantially vertical connecting arms 18, 18 integrally formed therebetween. The connecting arms 18, 18 each have a downwardly open mortise 22 at the bottom and an upwardly projecting tendon 24 at the top. The structural unit has various uses including the construction of retaining walls and further illustration and description is found in U.S. application Ser. No. 968,476 on IMPROVED PRECAST CONCRETE STRUCTURAL UNIT AND COMPOSITE WALL STRUCTURE in the names of Roger L. Toffolon and Warren L. Brown.

A multi-part form shown in FIGS. 2 and 3 and constructed in accordance with the present invention includes a stationary base and support means indicated generally at 26. The base and support means may be constructed as illustrated in a welded form with I-beams 28, 30 forming side support members and I-beams 32, 32, one shown, extending therebetween as connecting arms. Horizontally upwardly exposed surfaces for forming the bottom surface of each sidewall and arm of a structural unit 10 are provided by the base and support means 26. Surface 34 and surface 36 form the bottom of the sidewalls 12, 12 of the structural unit and surfaces 38, 40 form the bottom of the arms of the structural unit. As best illustrated in FIG. 3 a slight downwardly inclined plane 42 is provided adjacent a flat 44 at an outer edge of the surface 34 and similar provision is made at the outer edge of the surface 36. This results in a small longitudinal depending flange along the outer edges of the sidewalls 12, 12 of a structural unit, not shown in FIG. 1. When the structural units are stacked one atop the other the small flange provides for a shingled effect in an alternative embodiment of the structural unit of FIG. 1.

As will be noted, the surfaces 38, 40 are somewhat depressed relative to the surfaces 34, 36 and this also accommodates an alternative embodiment of the structural unit of FIG. 1 wherein the lower portions of the arms 18, 18 project slightly below the lower surfaces of the sidewalls 12, 12. Further, the surfaces 38, 40 each include a box-like upwardly projecting and mortise forming structure 42.

A stationary core means indicated generally at 46 takes a generally rectangular configuration viewed from above and has substantially vertically outwardly exposed surfaces for forming the inner surfaces of the arms 18, 18 of a structural unit and for forming the inner surfaces of sidewalls 12, 12 of the unit between the arms. Thus, surface 48 in FIG. 3 forms the inner surface of a sidewall 12 of a structural unit and the vertical surface 50 forms an inner surface of an arm 18. The corresponding surfaces on the core means, not shown, form the inner surface of a sidewall between arms and the inner surface of the other arm 18. At the top of the surface 50 an upwardly projecting plate 52 forms the inner surface of a tendon 24 and an opposing plate 52 similarly forms the inner surface of a tendon 24 on the other arm. The core means 46 may of course be constructed with internal bracing members as illustrated and may be secured in position as by welding atop the base and support means 26.

The multi-part form also includes a pair of movable similar but opposite sidewall form members indicated generally at 54, 54. The members 54, 54 have substantially vertical surfaces such as the surface 56 illustrated which form the substantially vertical outer surfaces respectively of the opposite sidewalls 12, 12 of a structural unit 10. Sidewall end surface form members are also provided and are preferably constructed as illustrated integrally with the form members 54, 54 at opposite ends thereof. Thus, sidewall end surface form members 58, 58 are formed at each end of the left-hand or upper member 54 in FIG. 3 and similar sidewall end surface form members 58, 58 are formed at opposite ends of the right-hand or lower member 54. The members 58, 58 have vertical surfaces 60, 60 which form the substantially vertical surfaces at the ends of the sidewalls 12, 12 of a structural unit 10. Various vertical and horizontal bracing members are provided for the form members 54, 58 and, in particular, lower, upper, and intermediate horizontal bracing members 62, 62 are associated with the plates forming the inner surfaces of the form members in each instance and extend around the ends of the plates which form the end surfaces 60, 60.

Movable form members indicated generally at 64, 64 serve to form outer surfaces of arms 18, 18 in a structural unit and inner surfaces of sidewalls 12, 12 outwardly of the arms and respectively at opposite ends of the structural unit. Thus, an arm-forming plate or surface 66 shown in the upper or right-hand member 64 forms the outer surface of one arm 18 and a similar surface on the lower or left-hand member 64 forms the outer surface of the opposite arm. Plates 68, 68 have vertical outwardly exposed surfaces for forming inner surfaces of sidewalls 12, 12 outboard or outwardly of the arms 18, 18. Various bracing or frame members in vertical and horizontal orientation support the plates 66, 68 which define the forming surfaces and, in particular, lower, upper and intermediate frame or bracing members 70, 70 extend substantially and when the form members are in closed or assembled position as in FIG. 2, the bracing or frame members 70, 70 have projecting end portions which align with the aforementioned horizontal frame or bracing members 62, 62 on the form members 54, 58.

At the top of the form members 64, 64, tendon forming means are provided and preferably take the form of vertical and horizontal plates 72, 74. The plate 72 forms the outer surface of a tendon 24 and the plates 74, 74 form the end surfaces of the tendon. Further, the plates 74, 74 cooperate with the aforementioned plates 52, 52 on the core means 46 in enclosing and defining a cavity for a tendon. Preferably the tendon forming means is movable between operative and inoperative positions by means of a hinge element 76 beneath a protective plate 78. Thus, the tendon forming means may be swung upwardly and outwardly for pouring of concrete or mix into an arm cavity or, it may be maintained in the position shown for pouring and thereafter swung upwardly and outwardly during stripping and removal of the cast structural unit.

As will be apparent from the foregoing, the various movable form members are moved inwardly to the assembled position of FIG. 2 during pouring of concrete or mix and casting of a structural unit. The various vertical forming surfaces described above define vertically upwardly exposed sidewall and arm cavities respectively at 80, 80 and 82, 82. In pouring or depositing mix in the cavities 80, 82 it is preferred that the top of the core means 46 be covered and, accordingly, a core means cover is provided in accordance with the invention. Further, a cover means 84 in FIG. 2 extends over the top of the cavities 80, 82. Thus, opening 86, 86 allow mix to progress downwardly from the surface 88 into the cavities 82, 82 through the tendon forming means 72, 74 etc. and side openings 90 allow the mix to progress downwardly into the cavities 80, 80. Short upstanding sidewalls 92, 92 on the cover means 84 serve to retain the mix piled atop surface 88 and an operator may trowel the mix into the openings 86, 90. Vibration may also be employed during filling of the cavities 80, 82 and vibrating means 94, 94 within the core means 46, FIG. 3, may be operated for this purpose. Further, other vibrating means not shown may be attached externally to the movable form members. When the cavities have been filled, the cover 84 or "mud pan" may be lifted upwardly by means of a loop 96 and thereafter troweling of the upper or top surfaces of the arms and sidewalls of the structural unit may be accomplished. In this connection, it is to be noted that the upper edge portions of the various plates defining the aforementioned vertical forming surfaces of the form may be provided as required with knife-edges for ease and convenience in troweling.

Preferably slide and guideway means for accommodating inner and outer movement of the movable form members respectively for casting and stripping operations comprise outwardly projecting slides 98, 98 on the base and support means 26. The slides 98, 98 are provided in pairs along the sides of the base and support means for the movable form members 54, 54 and likewise in pairs at the ends of the base and support means for accommodating the movable frame means 64, 64. Further, the form members 54, 64 are provided with guides or guideway means 100, 100 operatively associated respectively with their corresponding slides 98, 98.

Tie and strip or stripping means preferably take the form of a plurality of tie bolts 102, 102 and a plurality of strip bolts 104, 104. Each side member 54 has 3, 3 tie bolts 102, 102 associated therewith and threadably entered through a small lug 106, 106 at the lower portion of the member. Aligned with the members 106, 106 on the base and support means 26 are small lugs 108, 108 having threaded openings for receiving the tie bolts 102, 102. On entry of a tie bolt 102 through the lug 106 and into the lug 108, it will be apparent that the form member 54 may be drawn into properly assembled position and with all tie bolts 102, 102 tightened the form member is readied for casting cooperating with the core means to define a cavity 80 as shown in FIG. 2. Preferably the lugs 106 and 108 are inclined slightly downwardly and inwardly so that when the tie bolts 102 are tightened, as by a power wrench, the form member 54 is drawn inwardly and downwardly to form a tight joint with the base and support means 26 and thus to prevent excessive leakage through the joint area.

Strip bolts 104, 104 are provided in pairs in association with each form member 54 and enter threaded openings in small lugs 110, 110 at a lower portion of the form member. When entered in the openings in the lugs the strip bolts can be brought into engagement with small aligned abutment means 112, 112 on the base and support means 26. Thus, rotation of the strip bolts 104, 104, on completion of a casting operation, will urge the form member 54 outwardly in a stripping operation, the tie bolts 102, 102, having first been withdrawn to permit such form movement. The strip bolts 104, 104 are also adapted for rapid power wrench operation.

Each of the movable form members 64, 64 has 3, 3 tie bolts 102, 102 associated therewith and 2, 2 strip bolts 104, 104. Corresponding lugs 106 for the tie bolts and 110 for the strip bolts have the same function as those described above. Similarly lugs 108, 108 on the base and support means 26 operate in the same manner as the lugs 108, 108 described above as do abutment means 112, 112. Operation of the tie and strip bolts associated with the movable form members 64, 64 is identical with that described above for the like elements associated with the side frame members 54, 54.

Preferably, tie and strip bolts are also associated with the aforementioned horizontal frame or brace members 62, 70 respectively on the frame members 54, 64. Thus, tie bolts 102, 102 are provided for each pair of members 62, 70 and enter the members 70 through suitably threaded openings and thereafter enter the members 62, 62 through suitable threaded openings so as to secure and tighten members 62, 70 in engagement with each other. This serves to close the vertical joint existing between the plates 60, 68. Each pair of members 62, 70 also has an associated strip bolt 104 which enters a suitably threaded opening in the member 70 and engages the associated member 62 so as to urge the members apart during a stripping operation.

As will be apparent from the foregoing, the multipart form of the present invention can be assembled and drawn tightly together as illustrated in FIG. 2 by the power assisted withdrawal of strip bolts and entry of tie bolts throughout the form. With the form so assembled, and with the cover or mud pan 84 in position, the mud or mix may be deposited in the cavities 80, 82, troweling of top surfaces completed and a curing term initiated. On completion of curing, the cover or mud pan may be removed, the tie bolts withdrawn rapidly with power assist as with a fast operating power wrench and the strip bolts entered slightly to accomplish the desired stripping operation. Vibration of the core and/or the movable frame members may also be accomplished for assistance in breaking the bond between the form and the cast structural part. Thereafter, the cast structural unit may be raised from the base and support means and its position about the core means and on preparation of the form a second unit may be cast.

In FIG. 4 there is illustrated a cylindrical member 114 which may be employed in lifting a cast structural unit subsequent to casting thereof. The cylindrical 114 may be secured in position as illustrated between form parts or plates at opposite sides of an arm 18 or a sidewall 12 as by means of a threaded rod 116 and nuts 118, 118. When the unit has been cast and cured, the rod 116 and threaded nuts 118 may be removed to provide a cylindrical member embedded in the case unit. As will be apparent, a plurality of such members may be employed with a lifting device having elements adapted to enter within the members for ease in raising and transporting the cast unit.

We claim:

1. A multi-part form for casting concrete structural units for retaining walls and the like, the structural units having generally rectangular horizontally spaced parallel and vertical sidewalls which extend longitudinally and which have horizontally spaced parallel and laterally extending substantially vertical connecting arms integrally formed therebetween, the connecting arms each having a downwardly open mortise at the bottom and an upwardly projecting tendon at the top; and the form comprising stationary base and support means including horizontally upwardly exposed surfaces for forming the bottom surface of each sidewall and arm of a structural unit as described, a stationary core means generally rectangular in configuration viewed from above and having substantially vertical outwardly exposed surfaces for forming the inner surfaces of the arms of a structural unit and the inner surface of sidewalls of the unit between the arms, a pair of movable similar but opposite sidewall form members having substantially vertical surfaces for forming the substantially vertical outer surfaces respectively of the opposite sidewalls of a structural unit, a pair of movable similar but opposite arm and sidewall form members having substantially vertical surfaces for forming the substantially vertical outer surfaces of the arms and inner surfaces of the sidewalls outwardly at the arms respectively at opposite ends of the structural unit, sidewall end surface form members having substantially vertical surfaces for forming the substantially vertical surfaces at the ends of the sidewalls of a structural unit, each of said latter form members being attached to and movable with one of said aforesaid movable members, tie means operatively associated respectively with each of said movable members and said stationary base and support means and serving to tie said movable members to said base and support means in inner and assembled positions of said movable members to provide a multi-part form for casting, and strip means operatively associated with each of said movable members and said stationary base and support means and serving to urge said movable members to outer and disassembled positions relative to said stationary base and support means in a form stripping operation.

2. A multi-part form for casting concrete structural units as defined in claim 1 wherein slide and guideway means are operatively associated with said stationary base and supporting means and each of said movable form means for inner and outer sliding movement of the latter respectively for casting and stripping of a structural unit.

3. A multi-part form for casting concrete structural units as set forth in claim 2 wherein said tie means comprise a plurality of complementary threaded tie bolt and nut means operatively associated with said stationary base and support means and each of said movable form members.

4. A multi-part form for casting concrete structural units as set forth in claim 3 wherein said strip means comprises a plurality of complementary threaded strip bolt, nut means and abutment means operatively associated with said stationary base and support means and each of said movable form members.

5. A multi-part form for casting concrete structural units as set forth in claim 4 wherein said sidewall end surface form members form a part of said movable opposite sidewall form members, and wherein tie and strip means are operatively associated with said sidewall end surface form members and said opposite arm and sidewall form members.

6. A multi-part form for casting concrete structural units as set forth in claim 5 wherein said slide and guide way means comprise outwardly projecting slide rails on said stationary base and support means and operatively associated guide ways on each of said movable form means.

7. A multi-part form for casting concrete structural units as set forth in claim 5 wherein the surfaces on said base and support means which form the bottom surface of each arm of a structural unit are provided with upwardly projecting mortise forming means.

8. A multi-part form for casting concrete structural units as set forth in claim 5 wherein said stationary core means and said opposite arm and sidewall form members include cooperating tendon forming members at upper portions thereof, the portion of said tendon forming members on said arm and sidewall form members being movable to operative casting positions and to inoperative positions for stripping.

9. A multi-part form for casting concrete structural units as set forth in claim 5 wherein said form comprises a cover member adapted to receive concrete during pouring and to aid in the distribution of same to sidewall and arm cavities in the assembled form.

10. A multi-part form for casting concrete structural units as set forth in claim 9 wherein said core means includes at least one vibrator means therewithin for breaking the bond of concrete thereabout subsequent to casting.

11. A multi-part form for casting concrete structural units as set forth in claim 9 wherein upper edge portions of said form adjacent sidewall and arm cavities take a knife-edge configuration for ease and convenience in troweling upper surfaces of a poured structural unit.

* * * * *